US005199455A

United States Patent [19]

Dlouhy

[11] Patent Number: 5,199,455

[45] Date of Patent: Apr. 6, 1993

[54] ANTI-SIPHON DEVICE FOR DRAIN CONDUITS

[75] Inventor: Anthony S. Dlouhy, Stevensville, Mich.

[73] Assignee: Chardon Rubber Company, Chardon, Ohio

[21] Appl. No.: 799,405

[22] Filed: Nov. 27, 1991

[51] Int. Cl.[5] ..... F16K 15/00

[52] U.S. Cl. ..... 137/217; 137/216; 137/855

[58] Field of Search ..... 137/215, 216, 217, 218, 137/360, 855, 800

[56] References Cited

U.S. PATENT DOCUMENTS

| | | | |
|---|---|---|---|
| 2,730,115 | 1/1956 | Hempel | 137/217 |
| 3,773,063 | 11/1973 | Roosa | 137/217 |
| 3,830,241 | 8/1974 | Dye et al. | 137/217 X |
| 5,096,233 | 3/1992 | Dlouhy | 285/153 |

*Primary Examiner*—John C. Fox

*Attorney, Agent, or Firm*—Renner, Kenner, Greive, Bobak, Taylor & Weber

[57] ABSTRACT

An anti-siphon drain conduit. First and second cylindrical tubular portions with a U-shaped tubular portion interposed therebetween, and communicating with, the first and second cylindrical tubular portions. A drain passage extends through the conjoined tubular portions. A siphon break passage communicates with the drain passage at approximately the intersection of one of the cylindrical tubular portion and the U-shaped portion. A flap valve is formed integrally with at least one of the tubular portions for closing the siphon break passage upon the presence of liquid flowing through the drain passage. A bleeder cap is fitted to the siphon break passage. The bleeder cap has a dome portion penetrated by an aperture and an accordion portion. The bleeder cap serves freely to admit atmospheric pressure therethrough while tending to restrict any liquid that inadvertently enters the siphon break from exiting the siphon passage into atmosphere.

10 Claims, 4 Drawing Sheets

ANTI-SIPHON DEVICE FOR DRAIN CONDUITS

TECHNICAL FIELD

The present invention relates generally to drain connections of the type particularly adapted for use in conjunction with household appliances. More particularly, the present invention relates to the connection between a household sanitary system and a drain hose which discharges waste fluid from a household appliance into the sanitary system. Specifically, the present invention relates to an anti-siphon drain conduit in the configuration of a gooseneck which is adapted to be interposed between the drain hose from a household appliance and the household grey water, or sanitary, system.

BACKGROUND OF THE INVENTION

The drain connection between a household appliance and a sanitary system often includes a standpipe. A hose or other flexible member is connected between the appliance and the standpipe. In other sanitary systems, the drain outlet of the appliance may be connected to a flexible hose which discharges into a laundry, or wash, tub. Should the outlet end of a drain hose become submerged below the drain water level in either a standpipe or tub, the hose is capable of siphoning the grey water back into the appliance, unless a siphon break has been provided between the appliance and the source of the grey water being so siphoned.

As such, drain connections have required the inclusion of a siphon break in the drain line at a location upstream with respect to the grey water which might be siphoned back into the appliance. One suitable solution to this problem was incorporated in the "Universal Standpipe Adaptor" that is the subject of U.S. patent application, Ser. No. 07/621,046 filed on Nov. 29, 1990, in the name of Anthony Dlouhy and assigned to the assignee of this application. This device provides a siphon break structure in conjunction with a universal adapter which can be connected to a sanitary system standpipe.

Other prior art approaches for providing a siphon break have been unduly complex and expensive to install. While these complex prior art devices may be effective, they will not accomodate all sanitary systems, and they do not provide a positive valving mechanism to prevent the leakage of liquid through the structural arrangement which provides the siphon break.

SUMMARY OF THE INVENTION

It is, therefore, a primary object of the present invention to provide an anti-siphon drain conduit which facilitates effecting an operable connection between the drain connection, which is presented from a household appliance, and the household sanitary system.

It is another object of the present invention to provide an anti-siphon drain conduit, as above, which incorporates a siphon break arrangement which provides communication between the interior of the drain conduit and atmosphere in order to prevent a "vacuum," or partial vacuum, from being established in the drain conduit.

It is further object of the present invention to provide an anti-siphon drain conduit, as above, which incorporates a structural assembly that also prevents the seepage of liquid through the siphon break.

It is still another object of the present invention to provide an anti-siphon drain conduit, as above, which is defined by a tubular member having inlet and outlet portions connected by a substantially U-shaped, central portion and wherein a siphon break assembly is operatively associated with the tubular member.

It is yet another object of the present invention to provide an anti-siphon drain conduit, as above, wherein a flap valve overlies the intersection of a siphon break passage with the drain passage through the tubular member to prevent liquid from entering the siphon break passage.

It is a still further object of the present invention to provide an anti-siphon drain conduit, as above, wherein the flap valve is formed integrally with the interior surface of the drain passage through the siphon drain conduit and oriented to define an opening directed downstream relative to the direction of the normal flow through the drain passage.

These and other objects of the invention, as well as the advantages thereof over existing and prior art forms, which will be apparent in view of the following detailed specification, are accomplished by means hereinafter described and claimed.

In general, an anti-siphon drain conduit embodying the concepts of the present invention utilizes a tubular member in the shape of a gooseneck, and the drain conduit incorporates an assembly which precludes siphoning of the drain water back into a household appliance such as a wash machine. The anti-siphon drain conduit also incorporates a built-in flap valve to prevent the drain fluid which exists the appliance from flowing into, and exiting through, the siphon break assembly. Should the outlet end of a drain hose become submerged below the level of the drain water in either a standpipe or a tub, the siphon break assembly is operable to prevent the drain water from being siphoned back into the appliance.

Another feature incorporated into the anti-siphon drain is that the flap valve has folded side walls which enhance the ability of the flap valve to conform to the interior surface of the drain passage and thereby more assuredly preclude the exit of drain water through the passage in the siphon break assembly.

The siphon break assembly also incorporates a bleeder cap arrangement having an accordion restriction which serves to assist in preventing fluid from exiting therethrough, and yet the restriction does not impair the necessary communication between the drain passage and atmosphere required to effect the siphon break function.

The anti-siphon drain conduit may be a molded rubber member which is configured to interact with the access to the household sanitary system, such as a standpipe or laundry tub. The preferably gooseneck-shape of the anti-siphon drain conduit helps to hold it in position and thereby to prevent it from popping out of the standpipe or falling out of the laundry tub. The added weight of the rubber gooseneck is also advantageous in helping to keep the drain hose in position. A molded rubber drain conduit of the type appropriate for the present invention can be manufactured using a conventional molding process.

The molding process can form grooves on the inner surface of the gooseneck-shaped drain conduit at the inlet end thereof to provide a means by which a watertight seal may be effected between the drain conduit and the drain hose under normal usage and also to allow the gooseneck to be rotatable with respect to the drain hose, thereby facilitating its cooperative interaction with the environment in which it is installed.

One exemplary embodiment of an anti-siphon drain member embodying the concepts of the present invention is described in detail and is deemed sufficient to effect a full disclosure of the subject invention. Although the exemplary anti-siphon member is described in detail, it is done so without attempting to show all of the various forms and modifications in which the invention might be embodied; the invention being measured by the appended claims and not by the details of the specification.

DESCRIPTION OF AN EXEMPLARY EMBODIMENT

Figure 1:
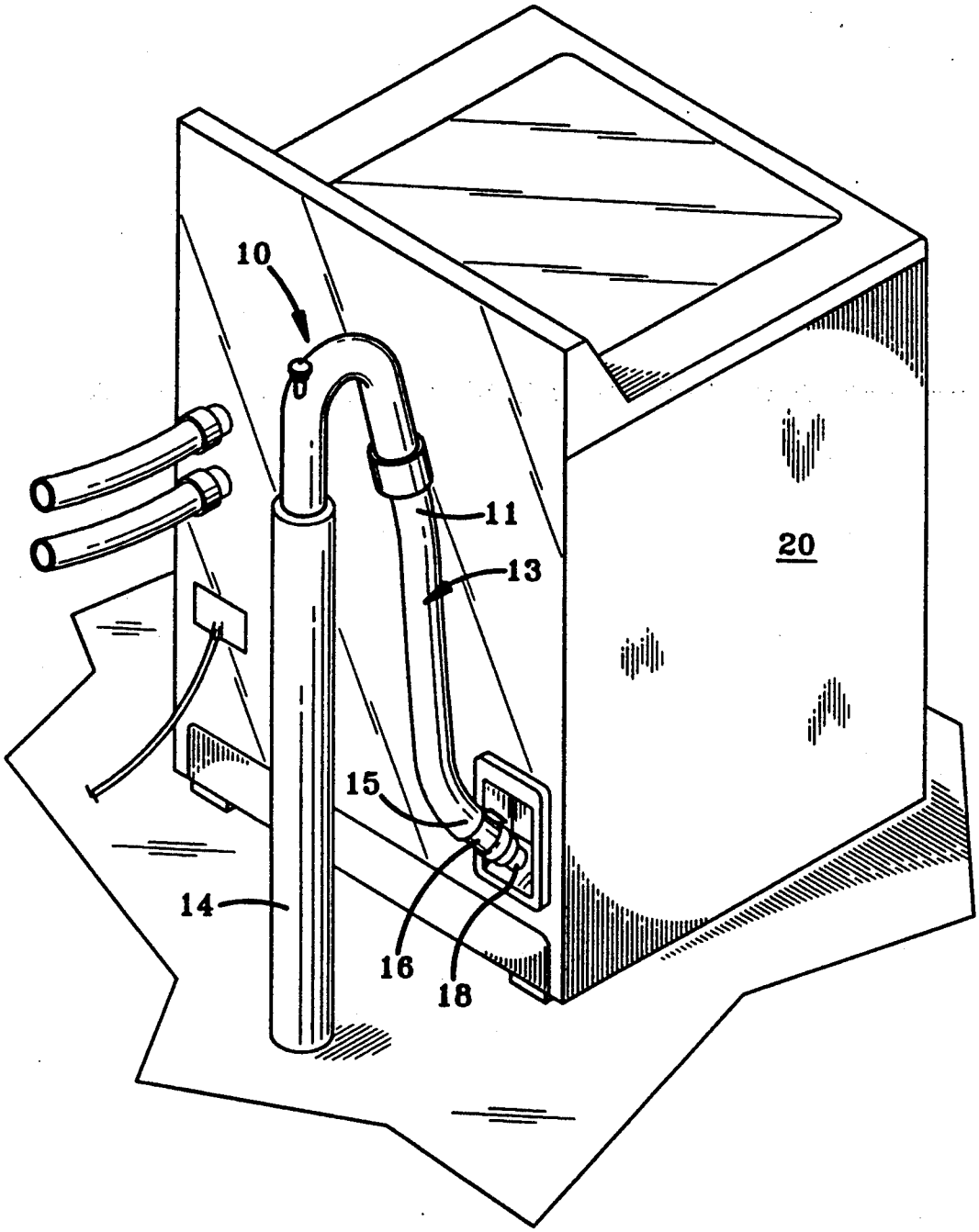
FIG. 1 is a schematic, rear perspective of a household appliance in the nature of a washing machine and depicting an anti-siphon drain conduit in the shape of a gooseneck which embodies the concepts of the present invention and which is interposed between a drain hose emanating from the appliance and a standpipe that communicates with the household sanitary system.

One representative form of an improved anti-siphon drain conduit embodying the concepts of the present invention is designated generally by the numeral 10 on the accompanying drawings. The representative drain conduit 10 is in the shape of a gooseneck and is operatively connected between the discharge end 11 of a drain hose 13 and a standpipe 14 which communicates with the household sanitary system (the remainder of which is not shown). The inlet end 15 of the drain hose 13 may be fitted with a conventional inlet cuff 16 of any of the many varieties currently employed for connection to the discharge tube 18 of a household appliance 20 such as the washing machine depicted.

The inlet cuff 16 and the drain hose 13 may be manufactured by well known molding practices and methods using thermoplastic materials. For example, the drain hose 13 may be made of polypropylene with the inlet cuff 16 integrally molded therewith and with the other end 11 molded to accommodate the anti-siphon drain conduit 10, as depicted in FIG. 2.

Figure 2:
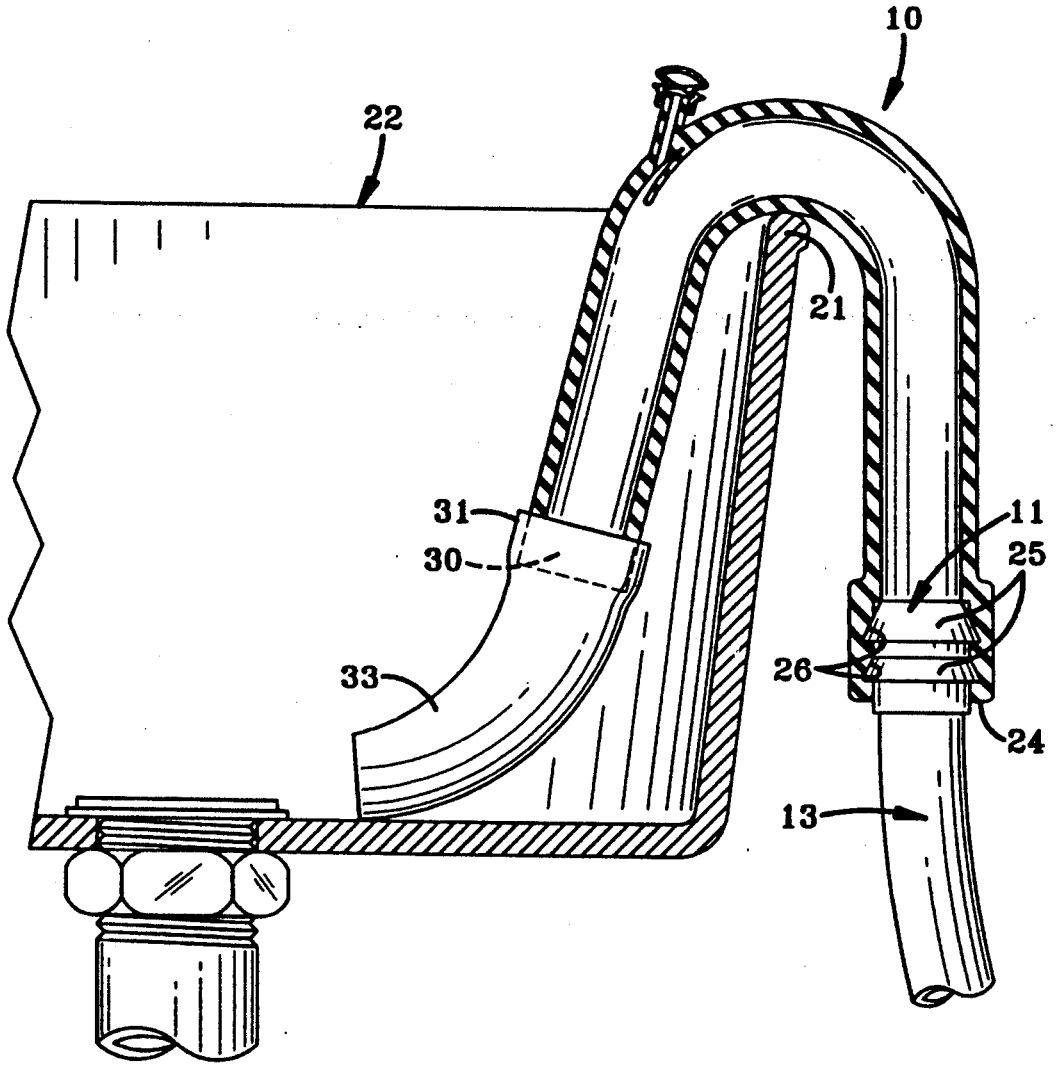
FIG. 2 is a partial side elevational view, partly in section, of a wash, or laundry, tub with the present drain conduit being supported across one edge thereof.
Figure 3:
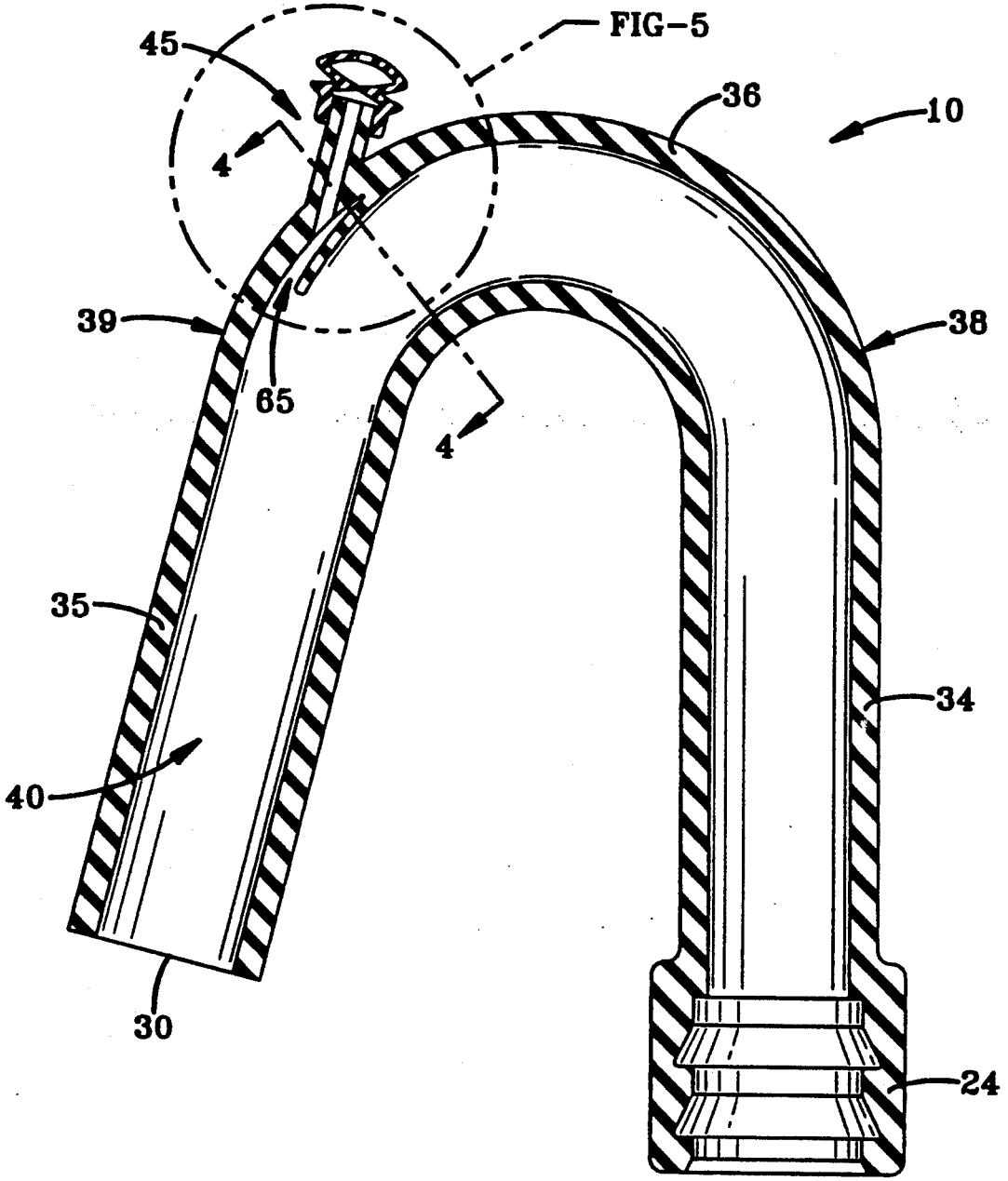
FIG. 3 is an enlarged, longitudinal sectional view through the anti-siphon drain conduit shown in FIGS. 1 and 2.

As depicted in FIG. 2, the same anti-siphon drain conduit 10 may also be positioned to straddle the rim edge 21 of a laundry tub 22. The discharge end 11 of the drain hose 13 is received within the inlet 24 of the anti-siphon drain conduit 10. The discharge end 11 of the drain hose 13 may be provided with a plurality of annular locking protuberances 25 formed thereon during the molding process which are adapted to fit tightly with mating annular recesses 26 formed in the inlet 24 of the drain conduit 10. As best seen in FIG. 3, the recesses 26 are each substantially triangular in cross section and disposed in such a manner as to facilitate insertion of the locking protuberances 25 but effectively to resist withdrawal. As such, the recesses 26 in the drain hose 13 cooperate with the locking protuberances 25 in the drain hose 13 to preclude the drain hose 13 from accidently, or inadvertently, being disengaged from within the inlet 24 of the anti-siphon conduit 10 while, at the same time, permitting rotation of the drain conduit 10 with respect to the drain hose 13 in order to facilitate positioning the drain conduit 10.

The anti-siphon drain conduit 10 has a discharge, or outlet, end 30 which is secured within the standpipe 14 (FIG.1) or within the end 31 of a second drain hose 33 which extends downward into a laundry wash tub 22. The drain hose 33 can be manufactured with the same molding technology used in the manufacture of the drain hose 13. The end 31 is substantially circular in cross-section and may be of such dimension as to fit tightly over the discharge end 30 of the anti-siphon drain conduit 10. The drain hose 33 may, of course, be omitted. However, without the second drain hose 35 the drain fluid may splash excessively in the bottom of the tub 22 and therefore result in some water splashing out of the tub 22 onto the floor.

As best seen in FIG. 3, the drain conduit 10 has a first, straight, tubular portion 34 integral with the inlet 24 and a second, straight, tubular portion 35 integral with the outlet 30. The tubular portions 34 and 35 are joined by a U-shaped tubular portion 36 which merges with the straight tubular portions 34 and 35 at what may be designated as the junctures 38 and 39, respectively. The tubular portions 34, 35 and 36 cooperate to provide a continuous drain passage 40 between the inlet 24 and the outlet 30. A siphon break assembly 45 is formed integrally with the U-shaped tube portion 36 substantially adjacent the juncture 39.

Figure 5:
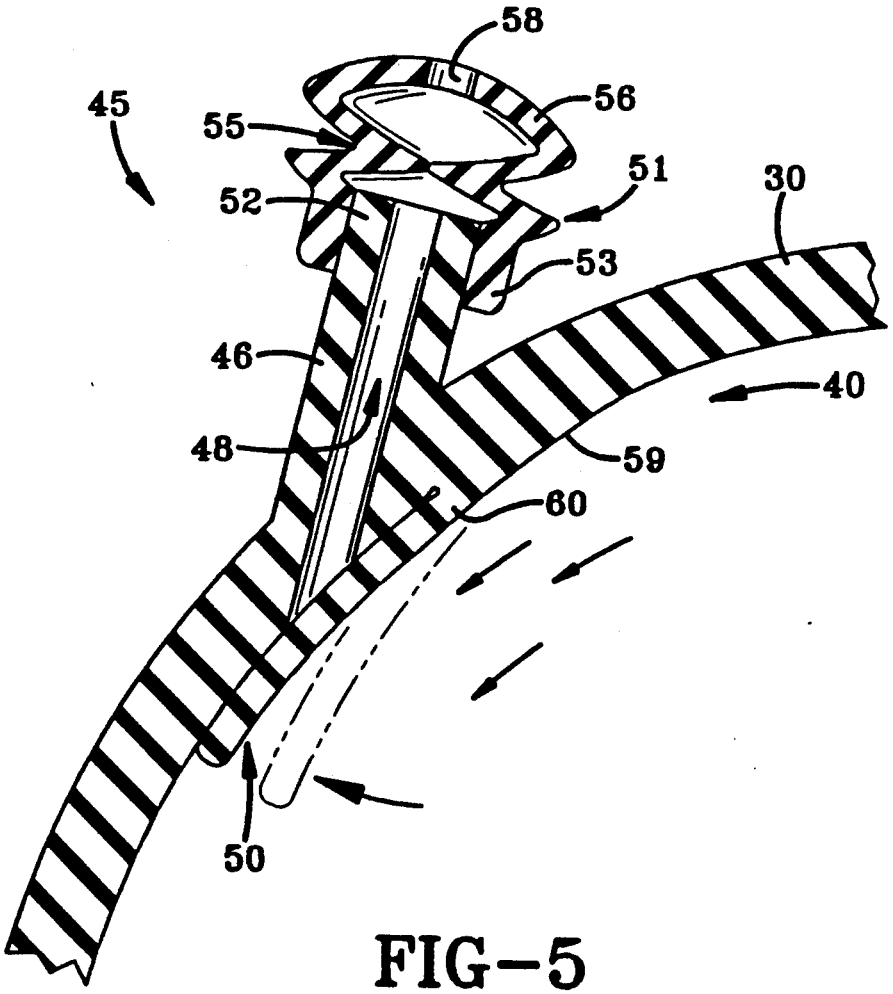
FIG. 5 is a further enlarged area of FIG. 3.

As is, perhaps, best seen in FIG. 5, the siphon break assembly 45 has a generally cylindrical stem portion 46 which surrounds a siphon break passage 48 that extends longitudinally through the stem portion 46 to intersect the drain passage 40 which passes through the anti-siphon drain conduit 10. The siphon break passage 48 should, as depicted, intersect the drain passage 40 which passes through the conduit 10 at an acute angle $\alpha$ of no more than 45 degrees. A flap, or reed, valve 50, which will be hereinafter described in greater detail, is interposed between the siphon break passage 48 and the drain passage 40.

The siphon break assembly 45 has a bleeder cap arrangement 51 fitted on the outer end portion 52 of the stem 46. The bleeder cap 51 has a cylindrical mounting portion 53 which surrounds, and secures, the bleeder cap 51 to the outer end portion 52 of the stem 46. An accordion, central portion 55 extends outwardly from the mounting portion 53 and terminates in a dome portion 56. The dome portion 56 has an aperture slot 58 formed therein which permits the siphon break passage 48 to communicate with the atmosphere. The accordion central portion 55 provides a further restriction against the discharge of liquid through the siphon break passage 48, while permitting relatively free flow of air from atmosphere into the siphon break passage 48.

Figure 4:
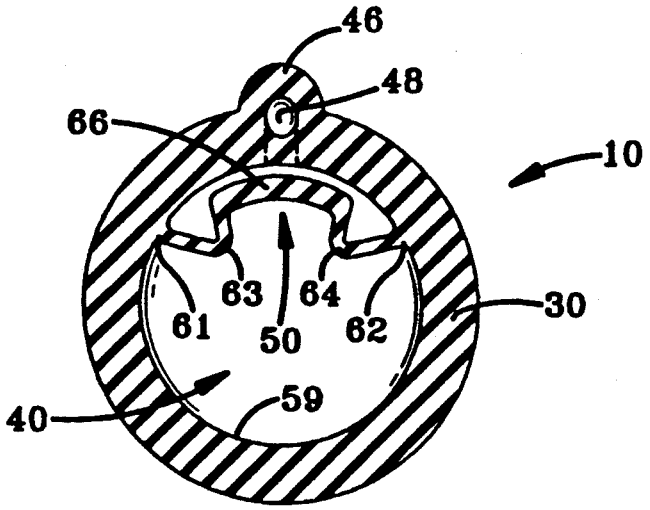
FIG. 4 is a cross sectional view taken along line 4—4 of FIG. 3.

The flap valve 50 is conjoined with the interior surface 59 of the drain passage 40 on three sides. The upstream end portion 60 of the flap valve 50 may be integral with the interior surface 59 of the drain passage 40, and, as best seen in FIG. 4, the two, lateral sides 61 and 62 of the flap valve 50 may be joined to the interior surface 59 by folding walls 63 and 64, respectively. This structure presents an opening 65 (FIG. 3) which faces downstream during the flow of drain water through the drain passage 40. The flexible connections between the upstream end portion 60 of the flap valve 50 as well as the use of folding walls 63 and 64 along the lateral sides 61 and 62 of the flap valve 50 permit the central portion 66 of the flap valve 50 to close the siphon break passage 48 to the flow of liquid (as represented by the arrows in FIG. 5) from drain passage 40. By placing the valve 50 along the exterior curve of the interior surface 59 of the drain passage 40 the liquid flowing through the passage 40 will exert the maximum, closing pressure upon the valve 50.

The anti-siphon drain conduit 10 is preferably made of rubber and may be manufactured by conventional molding processes. This permits the drain conduit 10 to be relatively heavy compared to the remainder of the drain hose. The weight of the drain conduit is an advantageous in maintaining the position of the drain hose 13, particularly when the drain conduit 10 is used with a laundry tub 22, as shown in FIG. 2.

During the discharge of liquid from an appliance, the valve 50 will close to prevent the flow of liquid through the siphon break passage 48. However, a modest amount of liquid may occasionally enter the passage 48. When this occurs, the accordion portion 55 will preclude the liquid from exiting through the aperture 58 in the dome portion 56 of the bleeder cap 51. When the liquid has fully discharged through the anti-siphon drain conduit 10, any liquid in the siphon break passage 48 will also drain back into the drain passage 40 and out through the discharge outlet 30.

On occasion, some fluid may remain in the standpipe 14, or even the laundry tub 22, after the discharge pump in the appliance 20 has emptied the appliance, and the pump has stopped operation. This may be due to a slow running, or plugged, drain. When this occurs the liquid in the drain hose 13 would be siphoned back into the appliance. This siphoning action is occasioned when the pressure within the discharge plumbing in the appliance 20 is reduced below atmospheric so that the pressure differential acting on the drain fluid in the standpipe 14, or the tub 22, will force the discharged liquid to reverse flow directions and be drawn back into the appliance. However, when the drain conduit 10 is employed, air will flow into the aperture 58, along the passage 48 and past the flap valve 50 into the drain passage 40, which immediately eliminates any pressure differential that would otherwise cause the siphoning of fluid back into the appliance.

The foregoing description of an exemplary embodiment of the present invention has been presented for the purposes of illustration and description. It is not intended to be exhaustive or to limit the invention to the precise form disclosed. Obvious modifications, or variations, are possible in light of the above teachings. The embodiment was chosen and described to provide the best illustration of the principles of the invention and its practical application in order to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only teaches that an anti-siphon drain conduit embodying the concepts of the present invention not only provides an operable connection between a household appliance and the household sanitary system but also accomplishes the other objects of the invention.

I claim:

1. An anti-siphon drain conduit comprising:

an assemblage of successive tubular portions;

said assemblage of tubular portions having an inlet and an outlet;

a drain passage passing through said tubular portions to communicate between said inlet and said outlet;

a siphon break assembly having a stem portion mounted on, and extending outwardly from, one of said tubular portions;

a siphon break passage passing through said stem portion to effect communication between said drain passage and atmosphere;

a bleeder cap mounted on said stem;

said bleeder cap having an accordion portion and a dome portion penetrated by an aperture.

2. An anti-siphon drain assembly, as set forth in claim 1, further comprising:

valve means for closing said siphon break passage thereby tending to preclude liquid from flowing out of the drain passage into said siphon break passage.

3. An anti-siphon drain assembly, as set forth in claim 2, wherein said valve means comprises:

a flap member overlying the intersection of said siphon break passage with said drain passage;

said flap member having three sides formed integrally with said tubular portion to define an opening facing downstream of the normal flow in said drain passage.

4. An anti-siphon drain assembly, as set forth in claim 2, wherein said valve means comprises:

a flap member having one edge integral with said tubular portion;

said flap member also having a pair of lateral edges;

a pair of folding walls joining said lateral edges with said tubular portion; and, a fourth edge defining an opening between said flap member and said tubular portion.

5. An anti-siphon drain conduit comprising:

first and second cylindrical tubular portions;

a U-shaped portion interposed between said first and second cylindrical tubular portions;

said first and second tubular portions as well as said U-shaped portion intersecting to define a drain passage extending through said conjoined portions;

a siphon break passage communicating with said drain passage at approximately the intersection of one said cylindrical tubular portion and said U-shaped portion.

6. An anti-siphon drain conduit, as set forth in claim 5, further comprising:

valve means formed integrally with at least one tubular portion for closing said siphon break passage upon the presence of liquid flowing through said drain passage.

7. An anti-siphon drain conduit, as set forth in claim 6, wherein:

said siphon break passage intersects said drain passage at an acute angle.

8. An anti-siphon drain conduit, as set forth in claim 7 wherein:

said acute angle is no more than about 45 degrees.

9. An anti-siphon drain assembly, as set forth in claim 8, wherein:

said siphon break assembly has a stem portion extending outwardly from a tubular portion of the conduit with said siphon break passage passing through said stem portion;

a bleeder cap mounted on said stem portion;

said bleeder cap having an accordion portion and a dome portion penetrated by an aperture.

10. An anti-siphon drain assembly, as set forth in claim 9, wherein said valve means comprises:

a flap member having one edge integral with said tubular portion;

said flap member also having a pair of lateral edges;

a pair of folding walls joining said lateral edges with said tubular portion; and, a fourth edge defining an opening between said flap member and said tubular portion.

* * * * *